United States Patent [19]

Young

[11] Patent Number: 4,539,940

[45] Date of Patent: Sep. 10, 1985

[54] TUBE AND SHELL HEAT EXCHANGER WITH ANNULAR DISTRIBUTOR

[76] Inventor: Richard K. Young, c/o French, Hughes and Doescher, P.O. Box 2443, Bartlesville, Okla. 74005

[21] Appl. No.: 604,336

[22] Filed: Apr. 26, 1984

[51] Int. Cl.[3] ..... F22B 1/02

[52] U.S. Cl. ..... 122/32; 165/159

[58] Field of Search ..... 122/32, 33, 511, 512; 165/159, 158, 157

[56] References Cited

U.S. PATENT DOCUMENTS

| | | | |
|---|---|---|---|
| 3,901,659 | 8/1975 | Joklik et al. | 165/159 X |
| 4,198,929 | 4/1980 | Forestier et al. | 122/32 |
| 4,203,906 | 5/1980 | Takada et al. | 165/159 X |
| 4,352,341 | 10/1982 | Styslinger | 122/32 X |

*Primary Examiner*—Edward G. Favors

[57] ABSTRACT

A tube and shell heat exchanger with annular distributor has openings in the shell extending to the tube sheet and an annular distributor extending beyond the tube sheet.

20 Claims, 2 Drawing Figures

TUBE AND SHELL HEAT EXCHANGER WITH ANNULAR DISTRIBUTOR

This invention relates to tube and shell heat exchangers. In one of its more specific aspects, this invention relates to tube and shell heat exchangers utilizing an annular distributor. Another aspect of this invention is a process to at least partially evaporate a liquid in a tube and shell heat exchanger. Another aspect of this invention resides in a steam generator.

BACKGROUND OF THE INVENTION

Tube and shell heat exchangers have long been known as useful tools for heating fluids and using thermal energy. Such tube and shell heat exchangers have been developed to a significant degree of sophistication. These heat exchangers comprise a shell surrounding a tube bundle usually attached to a tube sheet. Fluid flowing through the shell is subjected to indirect heat exchange with another fluid flowing through the tubes.

Effective utilization of tube and shell heat exchangers as well as the avoiding of mechanical problems and the reduction of thermal stress in such apparatus is continuing goal in the industry.

THE INVENTION

One object of this invention is to provide an improved tube and shell heat exchanger avoiding gas pocket related mechanical and thermal problems.

Another object of this invention is to provide a vertical tube and shell heat exchanger with even flow of fluids in the shell side.

A yet further object of this invention is to provide a process for at least partially evaporating a liquid in a tube and shell heat exchanger.

A yet further object of this invention is to provide a steam generator with good efficiency of heat utilization and even steam flow.

These and other objects, advantages, features, details and embodiments of this invention will become apparent to those skilled in the art from the following detailed description of the invention, the appended claims and the drawing in which FIG. 1 is a partial representation of a tube and shell heat exchanger in accordance with this invention partially in cross-section.

FIG. 2 is a schematic view of a steam generator using the heat exchanger of this invention.

In accordance with this invention a tube and shell heat exchanger is provided having an annular distributor surrounding the shell in the area where the shell is attached to the tube sheet and extending past the shell side surface of the tube sheet. Preferably the annular distributor extends significantly past the entire tube sheet. The heat exchanger of this invention is provided with openings through the shell connecting the annular distributor and the interior of the shell which openings extend all the way to the shell side surface of the tube sheet. In other words, the openings are adjoining the shell side surface of the tube sheet; in yet other words, a fluid path is provided by these openings for fluid to flow from inside of the shell into the annular distributor, which path is an outward extension of the shell side surface of the tube sheet, a path flush with this surface. The combination of the annular distributor and the openings extending all the way to the shell side surface of the tube sheet results in various advantages and solves various problems to be discussed in the following. Broadly speaking this annular distributor and the specific openings prevent formation and trapping of a gas bubble in the case of a vertical tube and shell heat exchanger. The combination of the annular distributor and the openings as described also result in a sweeping effect due to flow of fluid tangentially along the shell side surface of the tube sheet. Thus, when the invention is employed at the shell inlet end of a tube and shell heat exchanger the incoming fluid would sweep across at least a portion of the shell side surface of the tube sheet avoiding in this portion stagnation of fluid or liquid and the thereby caused thermal oscillations.

The present invention solves two problems which have been discovered in conjunction with tube and shell type heat exchanging equipment. First, in a generally vertically arranged tube and shell heat exchanger used, for instance, in a vaporizer, the outlet (or nozzle) from an annular distributor surrounding the openings through the upper portion of the shell when located below the tube sheet causes vapor blanketing of this upper tube sheet. Generally the nozzle cannot be located against the tube sheet. Such a vapor blanket can cause the tube sheet to overheat and to experience sudden cooling as liquid penetrates the vapor blanket and strikes the tube sheet. Similarly, the tubes can be subjected to drying-out and then sudden cooling. Additionally, deposits can build up on the dry and hot tube surfaces. In accordance with this invention the problem can be avoided by the arrangement of the annular distributor chamber and the shell openings described. The annular distributor chamber is arranged to extend axially past the shell side surface of the tube sheet or past the tube sheet, as such and the openings through the shell extend all the way to the shell side surface of the tube sheet. In the specific embodiment of a vertical tube and shell heat exchanger in accordance with this invention a nozzle is attached to the annular distributor at a location where the nozzle opening of the distributor is at least in part above the shell side surface of the tube sheet. This arrangement prevents any formation of a vapor pocket below the tube sheet or blanketing of the tube sheet with hot vapor. In this embodiment the invention achieves particularly desirable advantages at the portion of the heat exchanger where the shell fluid leaves the shell.

A second problem that has been discovered and is solved by the above-described arrangement of annular distributor and shell openings can arise at the inlet end to such a tube and shell heat exchanger. When fluid, particularly liquid, enters the shell side of a shell and the heat exchanger having openings into the shell side from an annular distributor at an axial distance from the shell side surface of the tube sheet or not extending to this surface there is a possibility that due to lack of flow a vapor layer may form on the hot tube sheet which again may result in overheating of both the tube sheet and the tubes. This problem is avoided in accordance with the invention. The arrangement of the annular distributor and the openings causes the incoming fluid to flow at least to a significant extent tangentially along the shell side surface of the tube sheet thereby sweeping away vapor which the hot tube sheet may have created.

Thus, in accordance with a first embodiment of this invention there is provided an apparatus for passing two fluids into indirect heat exchange with each other. This apparatus comprises a shell, at least one tube sheet and a plurality of tubes piercing the tube sheet. The shell and the tube sheet are preferably rigidly attached to each other. This preferred rigid connection between the tube sheet and the shell can be achieved for instance by a welding connection. The rigid connection between the two elements allows the apparatus to be used under high pressure conditions. In this embodiment an annular distributor surrounds the tube sheet and at least a portion of the shell. This annular distributor provides an annular space which extends in axial direction beyond the shell side surface of the tube sheet and generally beyond the entire tube sheet. A plurality of openings through the shell are provided which openings form a fluid connection between the inside of the shell and the annular space of the annular distributor. These openings extend all the way to the shell side of the tube sheet thereby providing the possibility for tangential flow along the shell side of the tube sheet either into the inside of the shell or from the inside of the shell. Thereby vapor pocket formation can be prevented and sweeping flow of incoming fluid can be provided which removes at least a significant portion of any vapor formed on the tube sheet.

In a preferred embodiment, the apparatus of this invention is a vertical tube and shell heat exchanger. In this preferred embodiment, the annular distributor has an access opening which opening is located axially at a location at least in part beyond the shell side surface of the tube sheet. The axis of the opening will be approximately coinciding with the shell side surface of the tube sheet. In other words, in this preferred embodiment the shell side surface of the tube sheet geometrically extended outwardly beyond the edge of this tube sheet either intersects this opening into the annular distributor or lies entirely below this opening. In yet other words, in this preferred embodiment the opening to the annular distributor should not be entirely below the shell side surface of the tube sheet.

In accordance with a further embodiment of this invention a steam generator apparatus is provided. This apparatus comprises a steam drum which is at least partially filled with water and has a water outlet, a steam inlet and a steam outlet. A downcomer conduit is connected with one of its ends to said water outlet and with the other end is connected at least indirectly with the shell side of a tube and shell heat exchanger apparatus as described above. A riser conduit is attached with one of its ends to the annular distributor or housing surrounding the tube and shell heat exchanger near the outlet of the shell side. The other end of the riser conduit is in fluid communication with the steam drum. A source of heating fluid is in fluid communication with the inlet ends of the plurality of the tubes of the heat exchanger. This steam generator avoids vapor blanketing of the upper tube sheet and allows effective use of the heat exchange capabilities of the tube and sheet heat exchanger to generate steam.

In accordance with a yet further embodiment of this invention a process to at least partially evaporate a liquid is provided. The liquid to be evaporated is passed into the lower portion of the shell side of a tube and shell heat exchanger. This heat exchanger is constructed as described above. The heating fluid is passed at a temperature substantially higher than the temperature of liquid through the tubes of the tube and shell heat exchanger. The temperature of the heating fluid in the tubes is substantially higher than the temperature of the liquid or fluid in the shell of the heat exchanger. This heating of the fluid in the shell of the heat exchanger can cause a partial evaporation of the liquid. In accordance with this invention there is provided at least one open fluid path for fluid flow through the shell. This open path extends all the way to the shell side of the upper tube sheet and provides fluid communication between the shell and a annular chamber surrounding the shell and extending axially into an area above the shell side of the upper tube sheet. The heated fluid is then passed from the annular chamber through an opening in the housing defining the annular chamber for further processing. This opening is located axially with respect to the shell side surface of the tube sheet as described, i.e. the opening is not entirely below the geometrical extension of the shell side surface of the tube sheet. Fluid can therefore flow from the immediate vicinity of the shell side or lower side of the tube sheet to the opening in the annular distributor without any required downward flow. No trapping of a vapor "bubble" is thus possible and the heat shock problems associated with such a trapped bubble are avoided. In yet other words the invention utilizes an arrangement of an annular distributor and shell openings into the annular distributor which is such that no liquid seal between the shell side of the tube sheet and the opening in the annular distributor can exist.

In accordance with a still further embodiment of this invention a process for heating a fluid in a tube and shell type heat exchanger equipment is provided. In accordance with this process a liquid to be heated is passed into a tube and shell heat exchanger. In this embodiment the inlet portion to the shell side for this liquid is provided with the annular distributor and the openings through the shell side as described above. The liquid being passed into the annular distributor flows at least to a significant extent from the annular distributor through the openings tangentially along the shell side surface of the tube sheet. Thereby the liquid sweeps along the tube sheet providing or removing vapor formation on the tube sheet surface.

In accordance with this invention it is presently preferred that the tube and shell heat exchanger here involved is one which has two tube sheets with the plurality of tubes extending from one tube sheet to the other tube sheet and wherein an annular distributor is employed either at the inlet portion of the shell or at the outlet portion of the shell or at both portions. The shell surrounds the tubes and is attached to both tube sheets, preferably rigidly.

The materials utilized in the heat exchanger of this invention are standard materials and comprise carbon steel as an example for the shell and alloy steels for the tube sheet.

In the drawing further preferred embodiments and details of this invention are shown. These drawings should, however, not be interpreted to unduly limit the scope of this invention.

Figure 1:
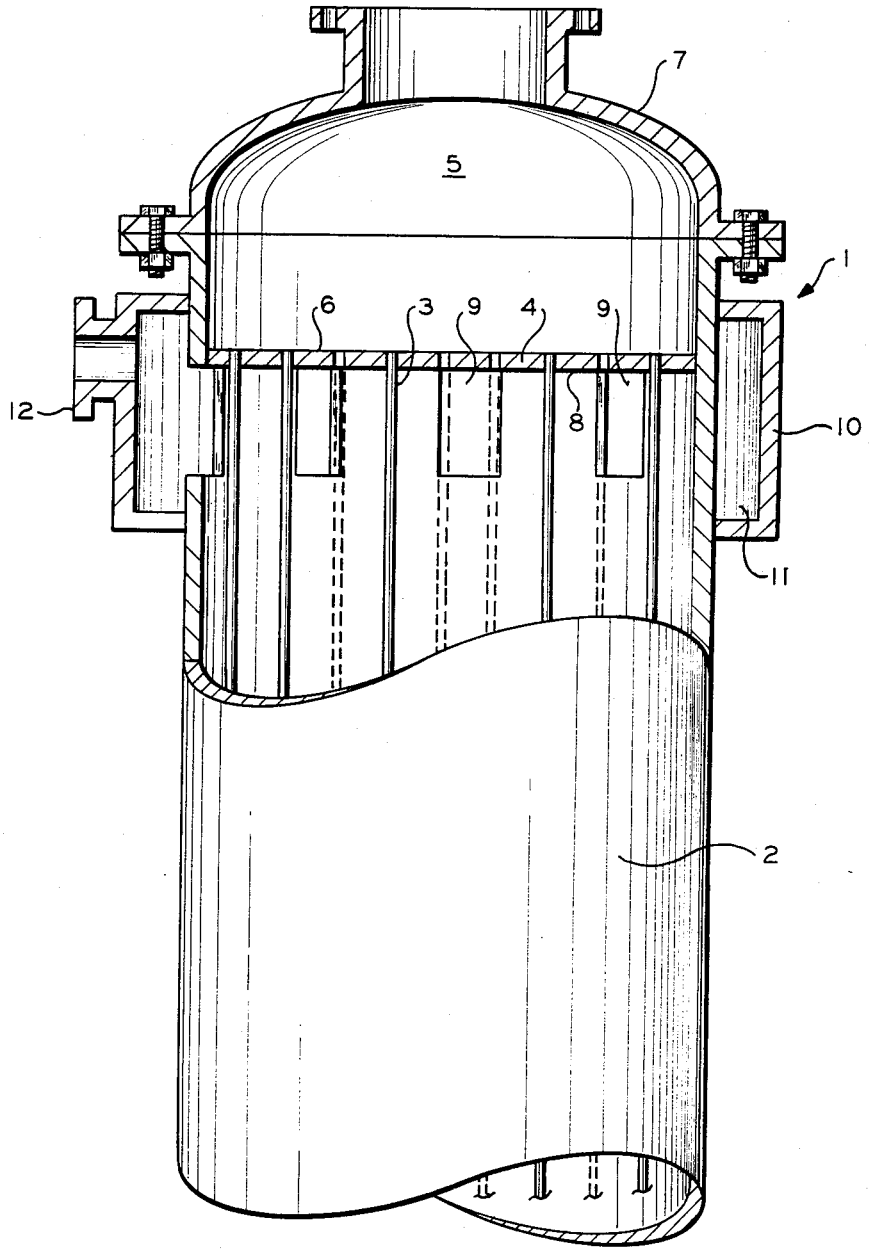
FIG. 1 shows partially in cross-section the upper portion of a vertically arranged tube and shell heat exchanger 1. A shell 2 surrounds a bundle of tubes 3 and a tube sheet 4. All of the tubes 3 are in fluid communication with a chamber 5 defines between the upper surface 6 of the tube sheet 4, the inner surface of the upper end of shell 2 and the bonnet 7.

The shell side surface 8 of the tube sheet 4 is frequently at a temperature substantially different from that at which the upper or outer surface 6 of the tube sheet 4 is. The shell 2 is provided with a number of slot-like openings 9 the size and distribution of which is controlled by mechanical stability considerations, flow considerations and the desire to utilize as much of the tube surfaces as possible for the heat exchange.

In order to accomplish even flow of fluid material through the openings 9 an annular distributor 10 is provided. This distributor 10 defines an annular space 11 between the distributor or housing 10 and the outside of shell 2. In accordance with this invention, this annular space 11 extends axially beyond the shell side surface 8 of the tube sheet 4 and in most instances significantly beyond the entire tube sheet 4. This construction makes it possible that the openings 9 reach all the way to the tube sheet 4 thereby avoiding any dead space along the tube sheet 4. Such dead space could cause the accumulation of vapor or the existence of stagnant liquid on the tube sheet 4.

Since the openings 9 extend all the way to the tube sheet 4 and thus provide fluid communication between the annular channel 11 and the shell side surface of the tube sheet 4 there can be and will be direct "sweeping" flow of fluid material along the shell side surface of this tube sheet 4. Thereby vapor pockets and stagnant liquid are largely avoided. Vapor blanketing of the upper tube sheet in the case of a vertical tube and shell heat exchanger can cause the tube sheet 4 to overheat or experience sudden cooling as liquid penetrates the vapor blanket and strikes the tube sheet. In a similar fashion the tubes 3 can experience dry-out and then sudden cooling by contact with liquid. Additionally, deposits can build up on the dry-hot tube surfaces. These problems are largely avoided by the present invention. The tube bundle does not need to be inclined nor is there a need for smaller vent nozzles close to the tube sheet.

The arrangement of this invention using an annular distributor chamber 11 reaching beyond the tube sheet 4 and providing inlet slots or openings 9 through the shell 2 which reach all the way to the shell side surface of the tube sheet 4 also has significant advantages in situations where this arrangement serves as the inlet side to the shell of a tube and shell heat exchanger 1. In this case the arrangement prevents liquid from getting into a stagnant position on tube sheet 4. The liquid or saturated fluid sweeps across substantial portions of the shell side surface of the tube sheet 4 and prevents such stagnancies.

In the case of the heat exchanger shown in FIG. 1, the housing or annular distributor 10 is provided with a nozzle 12 which is arranged in an axial position such that at least a portion of the opening of this nozzle 12 is above the shell side surface of the tube sheet 4. Frequently, it will be convenient to arrange the nozzle 12 in such a fashion that the axis of the nozzle coincides with the shell side surface of the tube sheet 4 or is even above it.

In the case of horizontally arranged heat exchangers in accordance with this invention the specific location of the nozzle 12 in axial direction is not as important as it is for the embodiment involving a vertical heat exchanger and in particular a vertical heat exchanger used in a vaporization unit.

Figure 2:
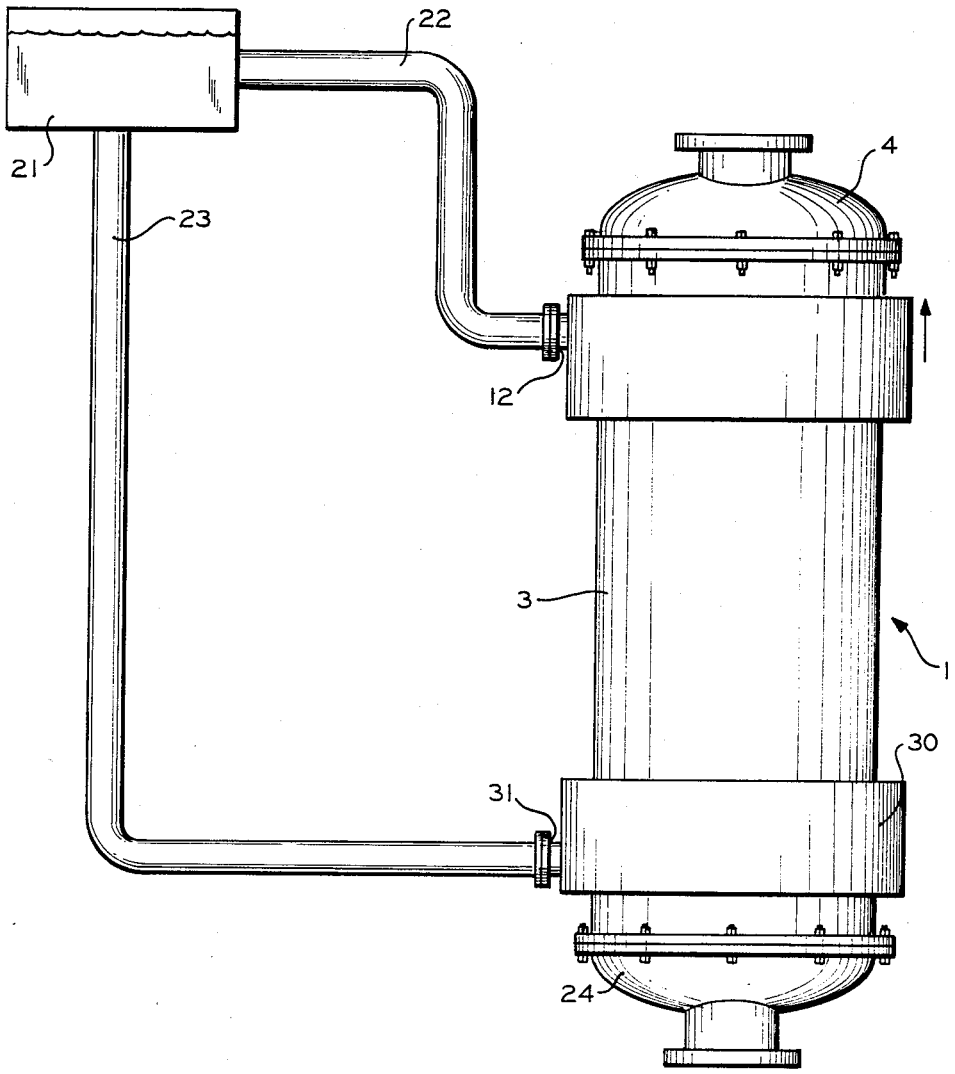

FIG. 2 shows the heat exchanger 1 in an application of a steam generator. A steam drum 21 is connected to a downcomer 23 which is a conduit through which substantially vapor free liquid, such as water, flows into the lower portion of the shell side of the tube and shell heat exchanger 1. The lower side and inlet into the shell side of heat exchanger 1 can be constructed in a very similar fashion as the upper or outlet side shown in FIG. 1. An annular distributor 30 with an inlet nozzle 31 connected to the downcomer 23 is shown in FIG. 2. The lower end of the heat exchanger 1 is closed with a bonnet 24 which can be similar to the bonnet 4 of the top end of the heat exchanger 1. Bonnets 4 and 24 can be attached to the shell 3 by a plurality of nuts and bolts.

Evaporated liquid or steam leaving the tube and shell heat exchanger 1 through chamber 11 (FIG. 1) and nozzle 12 is then passed via a riser 22 to the steam drum 21. Generally the fluid flowing through the riser 22 is composed of liquid and about 7–15% vapor.

Reasonable variations and modifications which will become apparent to those skilled in the art can be made from this invention without departing from the spirit and scope thereof.

I claim:

1. Apparatus for passing two fluids into indirect heat exchange relationship with each other comprising
   (a) a shell,
   (b) at least one tube sheet attached to the shell,
   (c) a plurality of tubes piercing the tube sheet,
   (d) an annular distributor surrounding the tube sheet and at least a portion of the shell, said annular distributor providing an annular space which extends in axial direction beyond the shell side surface of the tube sheet,
   (e) a plurality of openings through said shell providing a fluid connection between the inside of said shell and said annular space, said openings extending all the way to the shell side surface of said tube sheet.

2. Apparatus in accordance with claim 1 comprising an opening in said annular distributor which is located axially at least in part at or beyond the shell side surface of the tube sheet in direction toward the respective end of the heat exchanger.

3. Apparatus in accordance with claim 1 wherein the openings through said shell have substantially a rectangular shape with one side of the rectangular opening being flush with the shell side surface of the tube sheet.

4. A tube and shell heat exchanger comprising
   (a) a tube sheet having a shell side surface and an opposite exterior surface,
   (b) a plurality of tubes attached to said tube sheet permitting flow of a first fluid through the tube sheet and through said tubes, which tubes are parallel to each other and to a heat exchanger axis,
   (c) a shell attached to said tube sheet and surrounding said tubes thereby defining a flow space for a second fluid in said shell and in contact with the outside of said tubes, said shell having a shell axis substantially parallel to said heat exchanger axis and said flow space being defined between the interior of the shell, the shell side surface of the tube sheet and the exterior of the tubes,
   (d) a ring shaped housing surrounding the outside of said shell in the proximity of where said shell is attached to said tube sheet, said housing being in fluid connection with said shell and defining an annular space extending in the direction of the heat exchanger axis and said flow space in the proximity of said tube sheet, said annular space extending in direction of the heat exchanger axis from an area where this annular space surrounds a portion of the flow space within the shell in the proximity of the tube sheet to beyond the shell side surface of said tube sheet in the direction toward the respective end of the heat exchanger, (e) a plurality of openings through said shell connecting the interior of said shell with said annular space, said openings through said shell connecting the interior of said shell extending axially all the way to the shell side surface of said tube sheet, (f) an opening in said housing permitting flow of fluid into said annular space or from said annular space.

5. A shell and tube heat exchanger comprising (a) a tube sheet having a shell side surface and an opposite exterior surface, (b) a plurality of tubes attached to said tube sheet permitting flow of a first fluid through the tube sheet and through said tubes, which tubes are parallel to each other and to a heat exchanger axis, (c) a shell attached to said tube sheet and surrounding said tubes thereby defining a flow space for a second fluid in said shell and in contact with the outside of said tubes, said shell having a shell axis substantially parallel to said heat exchanger axis and said flow space being defined between the interior of the shell, the shell side surface of the tube sheet and the exterior of the tubes, (d) a ring shaped housing surrounding the outside of said shell in the proximity of where said shell is attached to said tube sheet, said housing being in fluid connection with said shell and defining an annular space extending in the direction of the heat exchanger axis said flow space in the proximity of said tube sheet, said annular space extending in direction of the heat exchanger axis from an area where this annular space surrounds a portion of the flow space within the shell in the proximity of the tube sheet to an area at least coinciding with the shell side surface of the tube sheet, (e) a plurality of openings through said shell connecting the interior of said shell with said annular space, said openings through said shell connecting the interior of said shell extending axially all the way to the shell side surface of said tube sheet, wherein said opening in said housing is located axially at least in part beyond said shell side surface of said tube sheet in the direction toward the respective end of the heat exchanger and (f) an opening in said housing permitting flow of fluid into said annular space or from said annular space.

6. Heat exchanger in accordance with claim 4 wherein said openings through said shell are substantially rectangularly shaped with one side of said rectangular opening coinciding with the shell side surface of said tube sheet.

7. A steam generator apparatus comprising (a) a steam drum at least partially filled with water having a water outlet, a steam inlet and a steam outlet, (b) a downcomer conduit connected with one end to said water outlet and with the other end at least indirectly with the shell side of a tube and shell heat exchanger which tube and shell heat exchanger comprises (aa) a tube sheet having a shell side surface and an opposite exterior surface, (bb) a plurality of tubes attached to said tube sheet permitting flow of a first fluid through the tube sheet and through said tubes, which tubes are parallel to each other and to a heat exchanger axis, (cc) a shell attached to said tube sheet and surrounding said tubes thereby defining a flow space for a second fluid in said shell and in contact with the outside of said tubes, said shell having a shell axis substantially parallel to said heat exchanger axis and said flow space being defined between the interior of the shell, the shell side surface of the tube sheet and the exterior of the tubes, (dd) a ring shaped housing surrounding the outside of said shell in the proximity of where said shell is attached to said tube sheet, said housing being in fluid connection with said shell and defining an annular space extending in direction of the heat exchanger axis around said flow space in the proximity of said tube sheet, said annular space extending in direction of the heat exchanger axis from an area where this annular space surrounds a portion of the flow space within the shell in the proximity of the tube sheet to beyond the shell side surface of said tube sheet in a direction toward the respective end of the heat exchanger, (ee) a plurality of openings through said shell connecting the interior of said shell with said annular space, said openings through said shell connecting the interior of said shell extending axially all the way to the shell side surface of said tube sheet, (ff) an opening in said housing permitting flow of fluid into said annular space or from said annular space, (c) a riser conduit attached to said housing and to said steam drum providing fluid communication between said opening in said housing and said steam drum, (d) a source of heating fluid in fluid communication with the inlet ends of said plurality of tubes.

8. A steam generator in accordance with claim 7 wherein said opening in said housing is located axially at least in part beyond said shell side surface of said tube sheet in a direction toward the respective end of the heat exchanger.

9. A steam generator in accordance with claim 7 wherein said openings through said shell are substantially rectangularly shaped with one side of said rectangular opening coinciding with the shell side surface of said tube sheet.

10. In a vertical tube and shell heat exchanger wherein a substantially vertically shell surrounds a plurality of tubes attached to an upper tube sheet and wherein the upper tube sheet is attached to the shell the improvement comprising a ring-shaped housing surrounding the shell in the proximity of the upper tube sheet forming an annular chamber extending axially upwardly at least to an axial location coinciding with the shell side surface of the upper tube sheet, a plurality of openings through said shell providing fluid connection between the inside of said shell and said annular chamber, said openings extending all the way to the shell side surface of the tube sheet, at least one opening through said housing which opening is at least in part above the shell side surface of the tube sheet.

11. Heat exchanger in accordance with claim 10 wherein said annular chamber extends upwardly beyond the axial location of the shell side surface of said tube sheet.

12. Heat exchanger in accordance with claim 10 wherein said openings through said shell are substantially rectangularly shaped and wherein one side of said rectangularly shaped openings coincides with the shell side surface of said tube sheet.

13. A process to heat a liquid comprising (a) passing said liquid into the lower portion of the shell side of a tube and shell heat exchanger, which tube and shell heat exchanger comprises a shell surrounding a plurality of tubes, said tubes being attached to an upper tube sheet, (b) passing a heating fluid at a temperature higher than the temperature of the liquid through the tubes of the tube and shell heat exchanger thereby heating said liquid, (c) providing a plurality of openings through said shell, which openings extend all the way to the shell side surface of the upper tube sheet and which openings provide fluid communication between the inside of the shell and an annular chamber defined by a housing annularly surrounding the shell in the proximity of said upper tube sheet, said annular chamber extending axially upwardly at least to the height of where the shell side surface of the upper tube sheet is located, (d) passing fluid from the annular chamber through an opening in said housing to further use, said opening being located axially so that a least a portion of said opening is located above the axial position of the shell side surface of the upper tube sheet.

14. Process in accordance with claim 13 wherein said annular chamber extends upwardly beyond the axial location of the shell side surface of the upper tube sheet.

15. Process in accordance with claim 13 wherein said openings through said shell are substantially rectangularly shaped and wherein one side of said rectangularly shaped openings coincide with the shell side surface of said upper tube sheet.

16. Process in accordance with claim 13 wherein said liquid is at least partially evaporated in said shell.

17. A process to heat a liquid in a tube and shell heat exchanger which heat exchanger comprises a shell surrounding a plurality of tubes, said tubes being attached to a tube sheet and said tube sheet being attached to said shell, said process comprising (a) passing said liquid into an annular chamber surrounding said shell in the vicinity of said tube sheet, said annular chamber extending axially at least into an area coinciding with the geometrical extension of the shell side surface of the tube sheet, said shell being provided with a plurality of openings extending all the way to the shell side surface of the tube sheet, (b) passing the liquid from said annular chamber through said openings into the inside of said shell and in a direction sweeping the surface of the tube sheet into contact with the outside of the tubes, (c) withdrawing heated fluid from the shell.

18. Process in accordance with claim 17 wherein said annular space extends beyond the axial location of the shell side surface of the tube sheet in the direction toward the respective end of the heat exchanger.

19. Process in accordance with claim 17 wherein said openings through said shell are substantially rectangularly shaped and wherein one side of said rectangularly shaped openings coincides with the shell side surface of said tube sheet.

20. Process in accordance with claim 17 wherein said liquid is at least partially evaporated in said shell.

* * * * *